US010288269B2

(12) United States Patent
Sareyka et al.

(10) Patent No.: US 10,288,269 B2
(45) Date of Patent: May 14, 2019

(54) CEILING SYSTEM

(71) Applicant: Worthington Armstrong Venture, Malvern, PA (US)

(72) Inventors: Brett W. Sareyka, Glen Mills, PA (US); Joshua L. Neal, Phoenixville, PA (US)

(73) Assignee: Worthington Armstrong Venture, Malvern, PA (US)

( * ) Notice: Subject to any disclaimer, the term of this patent is extended or adjusted under 35 U.S.C. 154(b) by 0 days.

(21) Appl. No.: 16/031,031

(22) Filed: Jul. 10, 2018

(65) Prior Publication Data

US 2018/0313523 A1 Nov. 1, 2018

Related U.S. Application Data

(62) Division of application No. 14/940,234, filed on Nov. 13, 2015, now Pat. No. 10,047,936.

(Continued)

(51) Int. Cl.
*F21V 21/02* (2006.01)
*E04B 9/00* (2006.01)

(Continued)

(52) U.S. Cl.
CPC ..... *F21V 21/025* (2013.01); *E04B 9/006* (2013.01); *E04B 9/068* (2013.01); *E04B 9/122* (2013.01);

(Continued)

(58) Field of Classification Search
CPC ..... F21V 21/025; E04B 9/068; E04B 9/122; E04B 9/006; E04B 9/18; F21S 8/043; E04C 2003/026
See application file for complete search history.

(56) References Cited

U.S. PATENT DOCUMENTS 2,376,715 A * 5/1945 Naysmith ..... E04B 9/32 362/150
2,854,205 A * 9/1958 Kruger ..... F21V 21/04 248/343

(Continued)

OTHER PUBLICATIONS

International Search Report by the European Patent Office dated Jan. 22, 2016 for International Application No. PCT/US2015/060574.

*Primary Examiner* — Anh T Mai
*Assistant Examiner* — Glenn D Zimmerman
(74) *Attorney, Agent, or Firm* — Stradley Ronon Stevens & Young, LLP

(57) ABSTRACT

A ceiling system in one embodiment includes first grid support members arranged in parallel spaced apart relationship. A pair of elongated lighting support members is arranged in parallel with the first grid support members. The lighting support members are spaced apart and define an axially elongated lighting opening. A lighting spacer bracket is connected between and supports the lighting support members from an overhead building support structure. In one embodiment, the bracket is configured to define a downwardly open cavity for at least partially receiving a lighting module therein. A lighting module is positioned in the lighting opening and supported by the lighting support members. In one embodiment, the lighting module may be a digital linear lighting module.

7 Claims, 12 Drawing Sheets

Related U.S. Application Data

(60) Provisional application No. 62/080,042, filed on Nov. 14, 2014.

(51) Int. Cl.

| | |
|---|---|
| ***E04B 9/18*** | (2006.01) |
| ***F21S 8/04*** | (2006.01) |
| ***E04B 9/12*** | (2006.01) |
| ***E04B 9/06*** | (2006.01) |
| *E04C 3/02* | (2006.01) |

(52) U.S. Cl.

CPC ..... *E04B 9/18* (2013.01); *F21S 8/043* (2013.01); *E04C 2003/026* (2013.01)

(56) References Cited

U.S. PATENT DOCUMENTS

| | | | | |
|---|---|---|---|---|
| 3,512,313 | A | | 5/1970 | Harz |
| 3,848,385 | A | | 11/1974 | Thompson |
| 4,015,811 | A | * | 4/1977 | Nute, Jr. ..... E04B 9/18 248/343 |
| 4,043,689 | A | | 8/1977 | Spencer et al. |
| 4,086,480 | A | | 4/1978 | Lahm |
| 4,449,166 | A | | 5/1984 | Sharp |
| 4,860,180 | A | | 8/1989 | Degelmann |
| 5,345,729 | A | | 9/1994 | Prahst et al. |
| 6,029,414 | A | | 2/2000 | MacLeod |
| 6,179,451 | B1 | | 1/2001 | Bodine et al. |
| 8,459,824 | B1 | | 6/2013 | Esmailzadeh et al. |
| 8,955,273 | B1 | | 2/2015 | Lehane, Jr. et al. |
| 2006/0262521 | A1 | | 11/2006 | Piepgras et al. |

* cited by examiner

CEILING SYSTEM

CROSS REFERENCE TO RELATED APPLICATIONS

This application claims priority to U.S. Provisional Application No. 62/080,042 filed on Nov. 14, 2014, and U.S. application Ser. No. 14/940,234 filed on Nov. 13, 2015, the contents of which are incorporated by reference herein, in their entirety and for all purposes.

TECHNICAL FIELD

The present invention relates to ceiling systems, and more particularly to a ceiling system configured for supporting lighting fixtures.

BACKGROUND

Some ceiling systems include a grid support system hung from an overhead structure which includes an array of orthogonally intersecting longitudinal grid support members and lateral grid support members arranged in fairly uniform pattern and intervals. The longitudinal grid support members and the lateral grid support members define a plurality of grid openings configured to support individual ceiling panels. Mechanical and electrical utilities (such as wiring, plumbing, etc.) may be conveniently routed in a hidden manner in the cavity or plenum formed above the longitudinal grid support members and the lateral grid support members and ceiling panels, making suspended ceilings a practical and popular ceiling option for residential, commercial, and industrial building spaces.

It is desirable to support various types of lighting fixtures from such suspended ceilings. One type of lighting fixture, sometimes referred to as linear lighting, includes a longitudinally extending frame containing a plurality of lighting elements or bulbs positioned along the length of the frame (e.g. LED, fluorescent, incandescent, halogen, etc.). Because such linear lighting fixtures have elongated lengths larger than the normal size of a single grid opening, supporting these type lighting fixtures without interrupting and adversely affecting the structural integrity of the grid support system is challenging without requiring cumbersome customization of the grid support members in the field, which is time consuming and expensive. Accordingly, an improved support system and installation method which permits mounting linear lighting in a suspended ceiling grid support system in a standardized, uniform manner is desirable.

SUMMARY

A ceiling system is provided which accommodates linear lighting and other similar elongated type lighting fixtures, thereby eliminating the need for extensive field customization.

The ceiling system in certain embodiments includes a specially-configured lighting spacer bracket configured for mounting in a standard ceiling grid support system. The spacer bracket may be structurally tied into a pair of opposing spaced apart lighting support members arranged to form a lighting opening in the ceiling grid support system. In one embodiment, the lighting support members may be axially aligned with a longitudinal grid support member, thereby forming a bifurcated extension of the longitudinal grid support member around the lighting opening. The spacer bracket is arranged to form a continuation of adjoining lateral grid support members orthogonally intersecting the lighting support members. The spacer bracket may be tied into the terminal ends of the lateral grid support members and creates a bridge or extension through the lighting opening, thereby providing uninterrupted and proper support of the ceiling grid support members in the vicinity of the lighting opening. The spacer bracket includes a cavity configured to receive the lighting fixture within the lighting opening.

In one embodiment, a ceiling system with lighting provisions includes an overhead grid support system including a plurality of first grid support members arranged in spaced apart relationship, each first grid support member defining a respective longitudinal axis. A pair of longitudinally extending lighting support members is arranged in parallel with the first grid support members, the lighting support members spaced apart from each other defining an axially elongated lighting opening. A lighting spacer bracket is connected between the lighting support members, the spacer bracket defining a downwardly open cavity configured to receive a lighting module. A lighting module is supported in the cavity by the lighting support members. In one embodiment, the lighting opening is axially aligned with the longitudinal axis of one of the first grid support members. The lighting module may be a linear lighting fixture in one embodiment.

In one embodiment, a lighting spacer bracket for supporting a lighting fixture in a ceiling system includes an elongated body, a substantially horizontal top wall, a first sidewall extending downwardly from the top wall, a second sidewall extending downwardly from the top wall, the first and second sidewalls spaced laterally apart, a mounting extension protruding laterally outwards from each of the first and second sidewalls in opposite directions, each mounting extension configured to engage a lighting support member of a ceiling grid support system, and a downwardly open cavity defined collectively by the top wall, first sidewall, and second sidewall. The cavity is configured to receive a lighting module.

A method for mounting a lighting module in a ceiling system is provided. The method includes the steps of: supporting a pair of axially elongated first and second lighting support members in an overhead grid support system; engaging a first end portion of a lighting spacer bracket with the first lighting support member; engaging a second end portion of the lighting spacer bracket with the second lighting support member, the first and second lighting support members being spaced laterally apart and defining a lighting opening; attaching the lighting spacer bracket to an overhead building support structure; and inserting a lighting module into the lighting opening.

BRIEF DESCRIPTION OF THE DRAWINGS

The invention is best understood from the following detailed description when read in conjunction with the accompanying drawing. It is emphasized that, according to common practice, the various features of the drawing are not to scale. On the contrary, the various features are arbitrarily expanded or reduced for clarity. Included in the drawing are the following figures.

DETAILED DESCRIPTION

Figure 1:
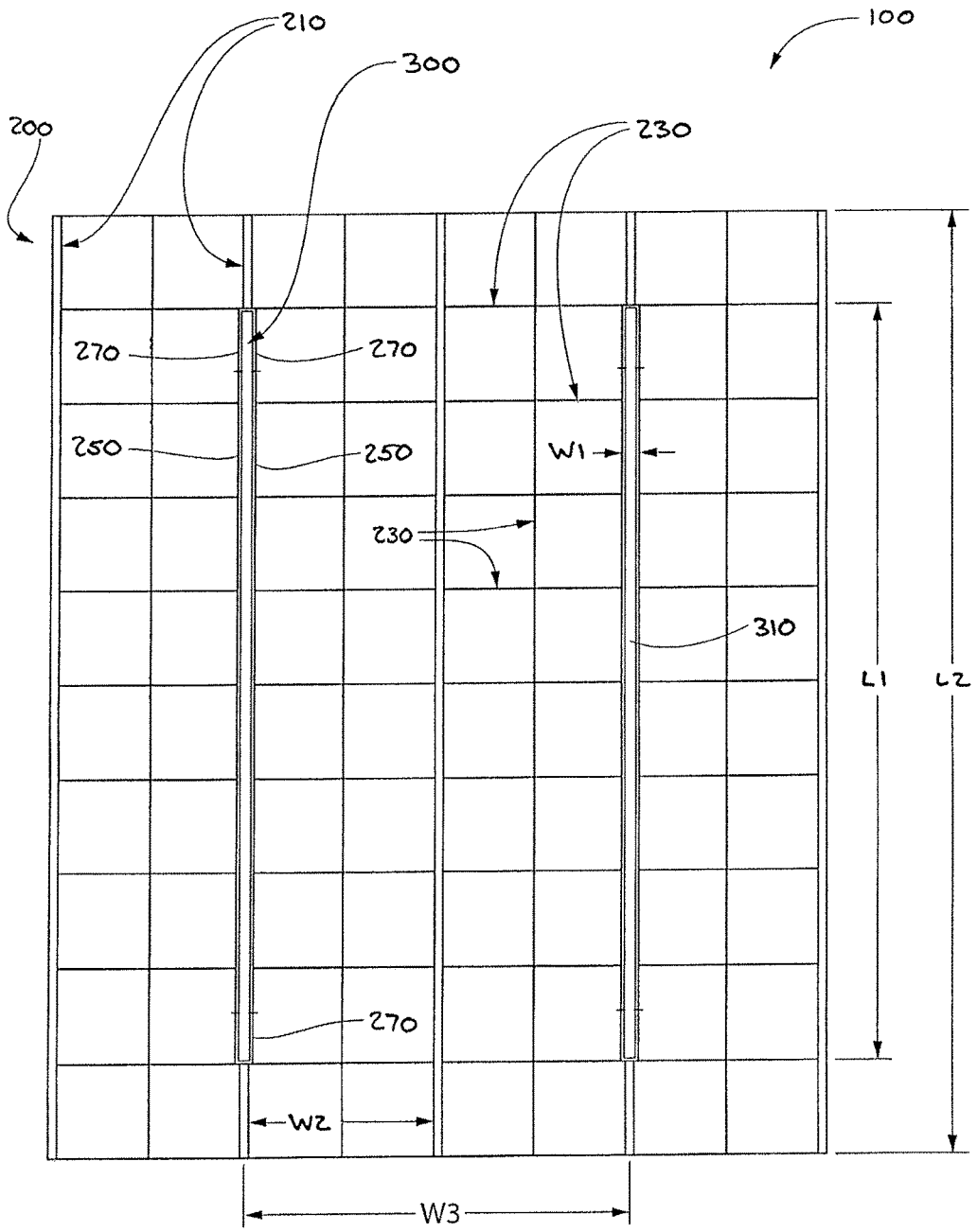
FIG. 1 is a bottom plan view of a ceiling system comprising a support grid formed by grid support members and lighting modules, according to an embodiment of the present invention.
Figure 2:
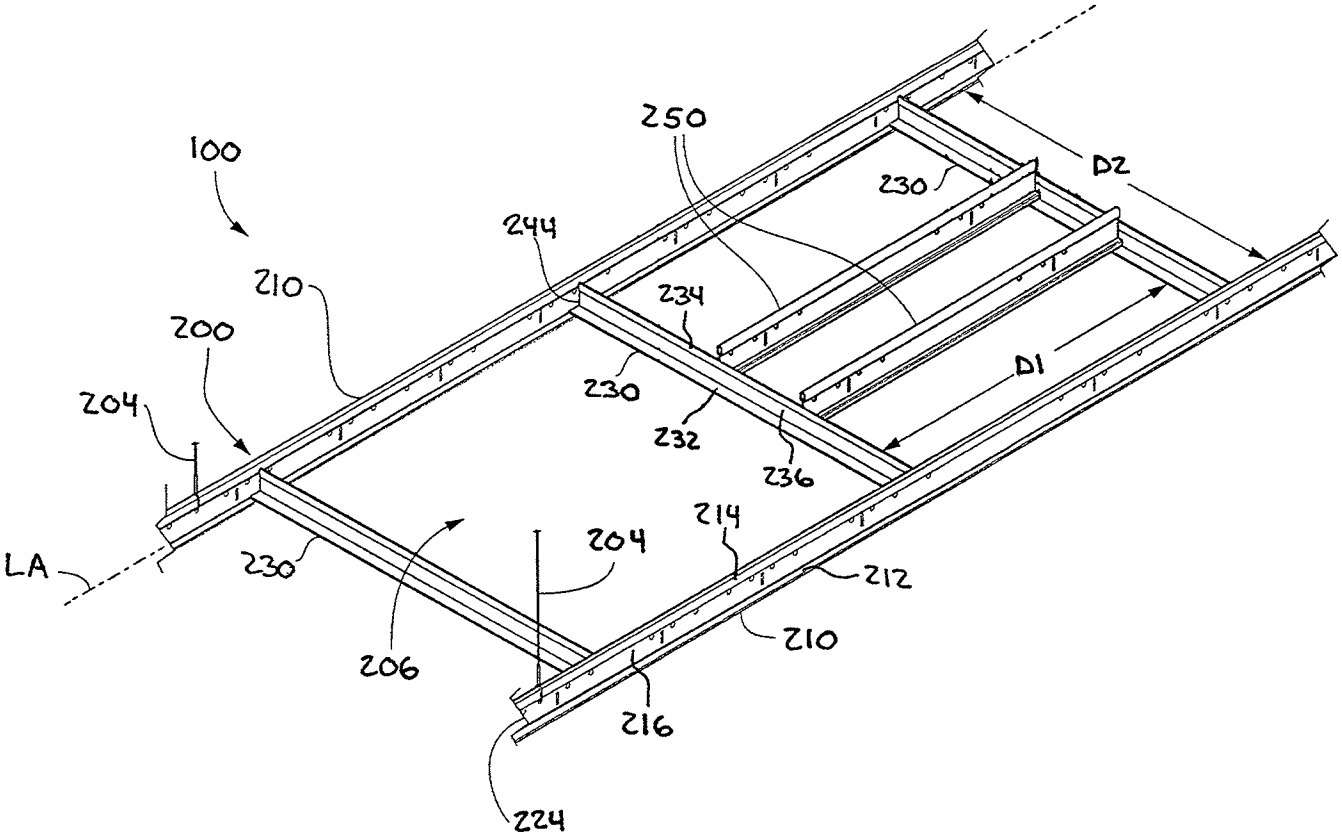
FIG. 2 is top perspective view of the grid support members and lighting support members of FIG. 1.

Referring now to the drawing, in which like reference numbers refer to like elements through the various figures that comprise the drawing, a ceiling system is provided which accommodates linear lighting and other similar elongated type lighting fixtures. In some exemplary embodiments, the ceiling system includes lighting support members and lighting spacer brackets which allow for the installation of a linear lighting module without the need for extensive field customization Referring now to FIGS. 1-3, a ceiling system 100 is provided according to an exemplary embodiment. FIG. 1 is a plan view of an exemplary embodiment of the ceiling system 100. FIG. 2 is perspective view of a portion of the support grid alone. The ceiling system 100 generally includes an overhead grid support system 200 configured to be mounted in a suspended manner from an overhead building support structure (not shown) via suitable hanger elements 204, such as for example without limitation fasteners, hangers, wires, cables, rods, struts, etc. The overhead grid support system 200 includes a plurality of intersecting longitudinal grid support members 210 (also referred to as main beams) and lateral grid support members 230 (also referred to as cross beams or cross tees). The longitudinal grid support members 210 alone may be may be hung by the hanger elements 204 from the overhead building support structure and provide support for the overhead grid support system 200. The lateral grid support members 230 are generally, but not necessarily, supported only by the longitudinal grid support members 210 without attachment to the overhead building support structure.

The longitudinal grid support members 210 and the lateral grid support members 230 are elongated in shape, having a length greater than their respective widths (e.g. at least twice as long). In various embodiments, the longitudinal grid support members 210 and the lateral grid support members 230 have lengths substantially greater than their widths (e.g. three times or more). The longitudinal grid support members 210 may have substantially greater lengths than the lateral grid support members 230 and form "runners" or "rails" which are maintained in a substantially parallel spaced apart relationship by the lateral grid support members 230. The lateral grid support members 230 may be attached to and between adjacent (but spaced apart) longitudinal grid support members 210 at appropriate intervals using any suitable permanent or detachable coupling elements. The combination of the interconnected longitudinal grid support members 210 and lateral grid support members 230 provides strength and lateral stability to the overhead grid support system 200. In one non-limiting example, the overhead grid support system 200 may be a Silhouette® slotted tee system available from Armstrong World Industries.

In one embodiment, the longitudinal grid support members 210 and the lateral grid support members 230 may be horizontally oriented when installed. It will be appreciated, however, that other suitable mounted orientations of the longitudinal grid support members 210 and the lateral grid support members 230 may be used, such as angled or sloped (i.e. between 0 and 90 degrees to horizontal). Accordingly, although the longitudinal grid support members 210 and the lateral grid support members 230 may be described in one exemplary orientation herein as horizontal, the invention is not limited to this orientation alone and other orientations may be used.

The longitudinal grid support members 210 and the lateral grid support members 230 intersect to form an array of grid openings 206 which receive and are essentially closed by ceiling tiles or panels 208 when positioned within the grid openings 206. In some embodiments, the longitudinal grid support members 210 and the lateral grid support members 230 may be arranged in an orthogonal pattern and intersect at right angles (i.e. perpendicular) to form the grid openings 206 which are rectilinear, such as squares or rectangles (in top plan view). The grid openings 206 are defined by first and second distances D1, D2 which are substantially coextensive with the length and width of the ceiling panels 208 to be installed in the grid openings 206. The ceiling panels 208 may be any type of ceiling panel, including without limitation for example square edge panels, stepped tegular edge panels creating a reveal, or other. The ceiling panels 208 may be constructed of any suitable material or combinations of different materials Some non-limiting examples of ceiling panel materials that may be used include, without limitation, mineral fiber board, fiberglass, metals, polymers, wood, composites, combinations thereof, or other.

Figure 3:
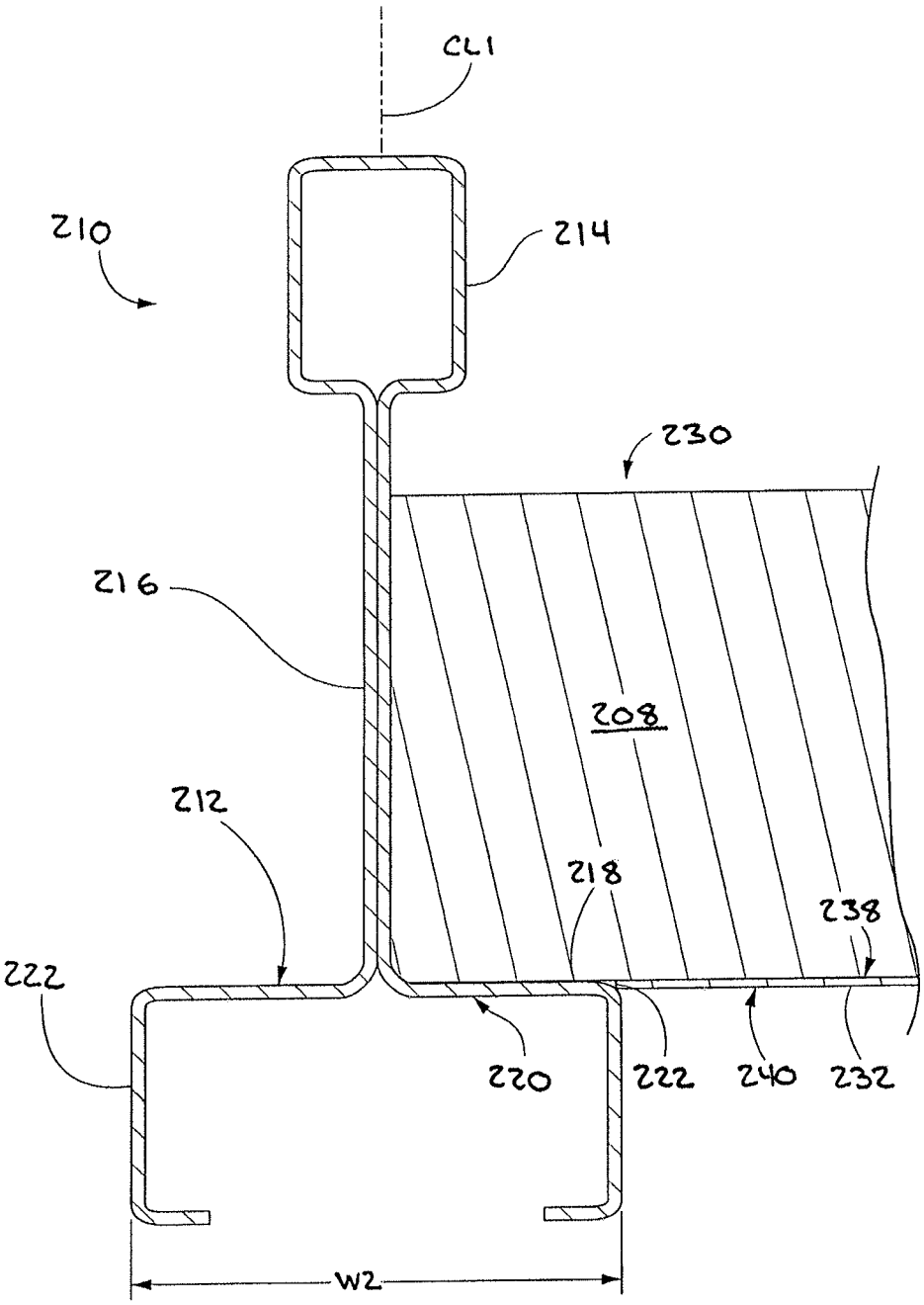
FIG. 3 is a side cross-sectional view of intersecting longitudinal and lateral grid support members, according to an embodiment of the present invention.

Referring to FIG. 3, which is a transverse cross-sectional view of a longitudinal grid support member 210 and a lateral grid support member 230 having a similar configuration to the longitudinal grid support member 210, each of the longitudinal grid support members 210 may be t-shaped in transverse cross section and include a longitudinally-extending horizontal bottom flange 212, an enlarged top stiffening channel 214 (also referred to as a bulb), and a vertical web 216 extending between the bottom flange 212 and the stiffening channel 214. In some embodiments, the stiffening channel 214 may be excluded. The bottom flange 212 has opposing portions which extend laterally outwards from web 216 and terminate in opposed axially extending longitudinal edges 222. The vertical web 216 may be centered between the longitudinal edges 222 and vertically aligned with the centerline CL1 of longitudinal grid support member 210, or laterally offset from the centerline CL1. The bottom flange 212 also includes a top surface 218 and a bottom surface 220. The bottom surface 220 defines a horizontal ceiling reference plane for the overhead grid support system 200.

The top surface 218 provides a surface for positioning and supporting the ceiling panels 208.

Similar to the longitudinal grid support members 210, each of the lateral grid support members 230 may be t-shaped in transverse cross section and include a longitudinally-extending horizontal bottom flange 232, an enlarged top stiffening channel 234 (also referred to as a bulb), and a vertical web 236 extending between the bottom flange 232 and the stiffening channel 234. In some embodiments, the stiffening channel 234 may be excluded. The bottom flange 232 has opposing portions which extend laterally outwards from web 236 and terminate in opposed axially extending longitudinal edges 242. The vertical web 236 may be centered between the longitudinal edges 232 and vertically aligned with the centerline CL1 of lateral grid support member 230, or laterally offset from the centerline CL1. The bottom flange 232 also includes a top surface 238 and a bottom surface 240. The bottom surface 240 defines a horizontal ceiling reference plane for the overhead grid support system 200. The top surface 238 provides a surface for positioning and supporting the ceiling panels 208.

Each of the longitudinal grid support members 210 and the lateral grid support members 230 may be made of any suitable metallic or non-metallic materials structured to support the dead weight or load of the ceiling panels 208 without undue deflection. In some non-limiting embodiments, the grid support members may be made of metal including aluminum, titanium, steel, or other. In some non-limiting embodiments, the longitudinal grid support members 210 and the lateral grid support members 230 may be a standard heavy duty 15/16 inch aluminum T-rail having a 15/16 inch grid face or 9/16 inch T-rail having a narrow 9/16 inch grid face.

The longitudinal grid support members 210 may be configured similarly or the same as the lateral grid support members 230, or each may be different. The terminal ends 244 of the lateral grid support members 230 have end connections configured for permanent or detachable connection to the vertical web 216 of one of the longitudinal grid support members 210 at a right angle to form a rectilinear grid pattern (see, e.g. FIGS. 2 and 7). Non-limiting examples of suitable connection means include permanent connection such as without limitation welding, soldering, etc., or detachable connection such as without limitation clips, brackets, threaded fasteners, interlocking tabs/slots, etc. Accordingly, the present invention is not limited by the manner of attachment or coupling used. The terminal ends 224 of the longitudinal grid support members 210 have end connections configured for permanent or detachable end-to-end connection to the terminal ends of adjoining longitudinal grid support member to form continuous spans of the longitudinal grid support members 210 (see, e.g. FIGS. 2 and 7). Similar permanent or detachable end connection means as those described above may be used. In some embodiments, a lower portion of the bottom flanges 232 of lateral grid support members 230 at the terminal ends 244 may be omitted when fabricated or notched/cut off in the field to also facilitate flush mating of the grid faces at intersections with the adjacent longitudinal grid support member 210 or lateral grid support member 230.

It will be appreciated that some lateral grid support members 230 may be run the same direction between and parallel to main beam longitudinal grid support members 210, as shown for example in FIG. 1. Accordingly, the lateral grid support members 230 are not limited in their use to only arrangement at right angles to the longitudinal grid support members 210.

Each of the longitudinal grid support members 210 and the lateral grid support members 230 defines a respective longitudinal axis LA and axial directions. At least some of the lateral grid support members 230 are arranged perpendicular to the longitudinal axis LA, as in FIG. 2. The bottom surfaces 220 of the longitudinal grid support members 210 and the bottom surfaces 240 of the lateral grid support members 230 preferably lie in the same horizontal plane when hung from the overhead support structure (not shown).

Features of the overhead grid support system 200 for accommodating lighting fixtures will now be described in further detail. In one embodiment, the lighting fixtures may be linear lighting luminaries or modules 310 which are fully supported solely by the overhead grid support system 200 without supplemental support from the overhead support structure from which the the longitudinal grid support members 210 and the lateral grid support members 230 are suspended. The lighting modules 310 may further be configured for installation entirely from below the grid system, thereby advantageously allowing both initial mounting and replacement without disturbing the grid or ceiling panels.

Referring to FIGS. 1-3 and 7-11, one or more lighting openings 300 are formed in the overhead grid support system 200 for mounting lighting modules 310. The lighting openings 300 define a lighting frame for supporting the lighting modules 310. In one embodiment, the lighting openings 300 are formed by a pair of laterally spaced apart lighting support members 250. The lighting support members 250 each have a length L1 which coincides with the length of the lighting module or modules 310 to be mounted in each of the lighting openings 300. The lateral width W1 of the lighting opening 300 is dimensioned to complement and substantially match the width of a lighting module 310 so that the lighting module 310 fills the entire space with minimal or no visible gaps around its perimeter.

The lighting support members 250 may have any suitable configuration which accommodates the mounting features of the lighting module 310 to properly support the fixture. In one embodiment, two longitudinal grid support members 210 may be used as the lighting support members 250 to form the lighting opening 300 if the lighting module 310 is to be arranged in the same direction as and parallel to the length of the longitudinal grid support members 210 in the ceiling system. The lighting modules 310 will therefore each be axially aligned with the longitudinal axis LA of a respective longitudinal grid support member 210. A width W1 separating the two lighting support members 250 may therefore be less than the normal lateral spacing or width W2 between the longitudinal grid support members 210 in the overhead grid support system 200 not associated with or used for mounting lighting modules 310. It will be appreciated that in other possible layouts of a lighting system for the ceiling system 100, two lateral grid support members 230 may be used as the lighting support members 250 to form the lighting opening 300 if the lighting module 310 is to be to be arranged in a direction perpendicular to the main beam longitudinal grid support members 210.

Figure 7:
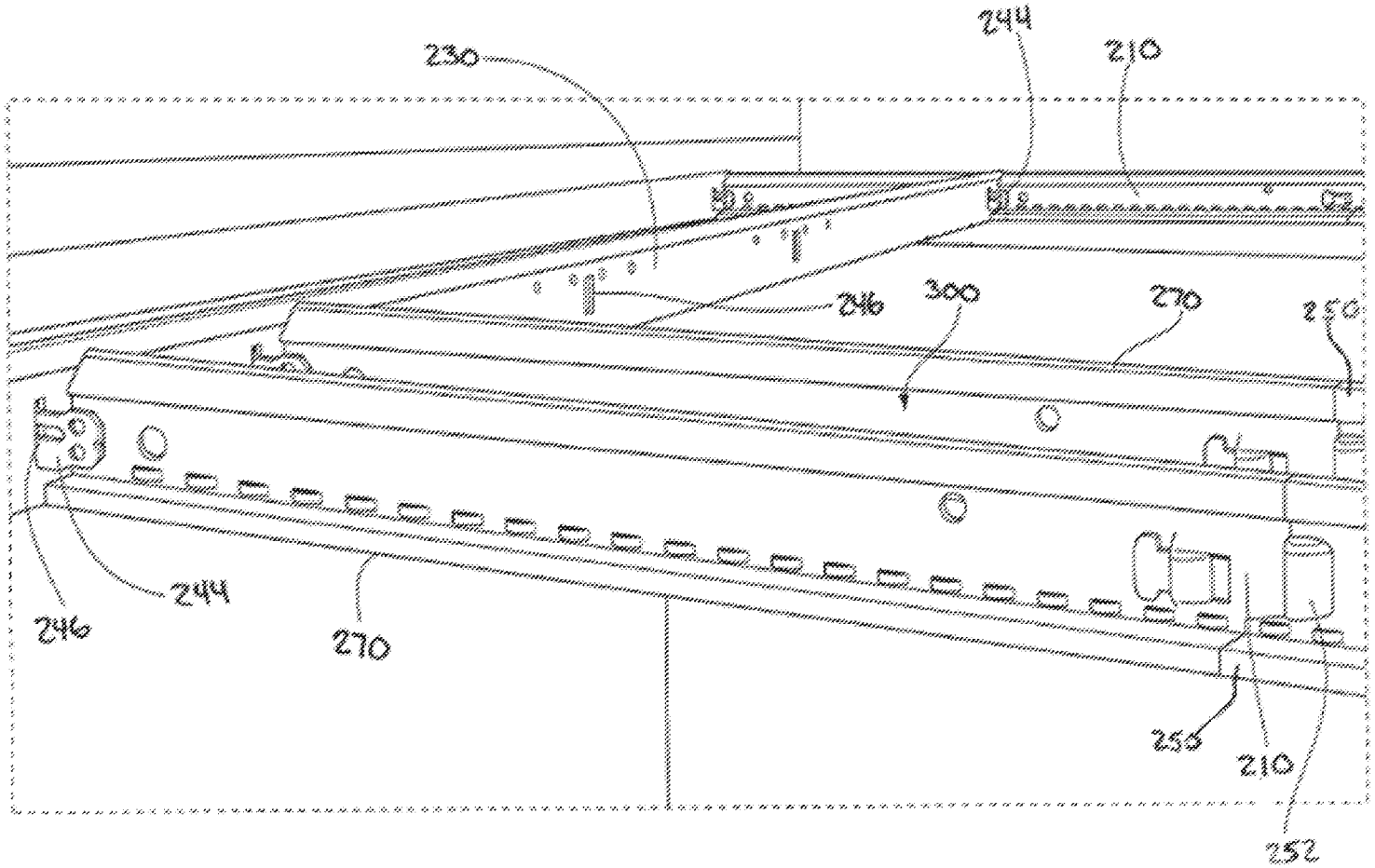
FIG. 7 is a top perspective view of the lighting support members mounted in the grid support system, according to an embodiment of the present invention.
Figure 8:
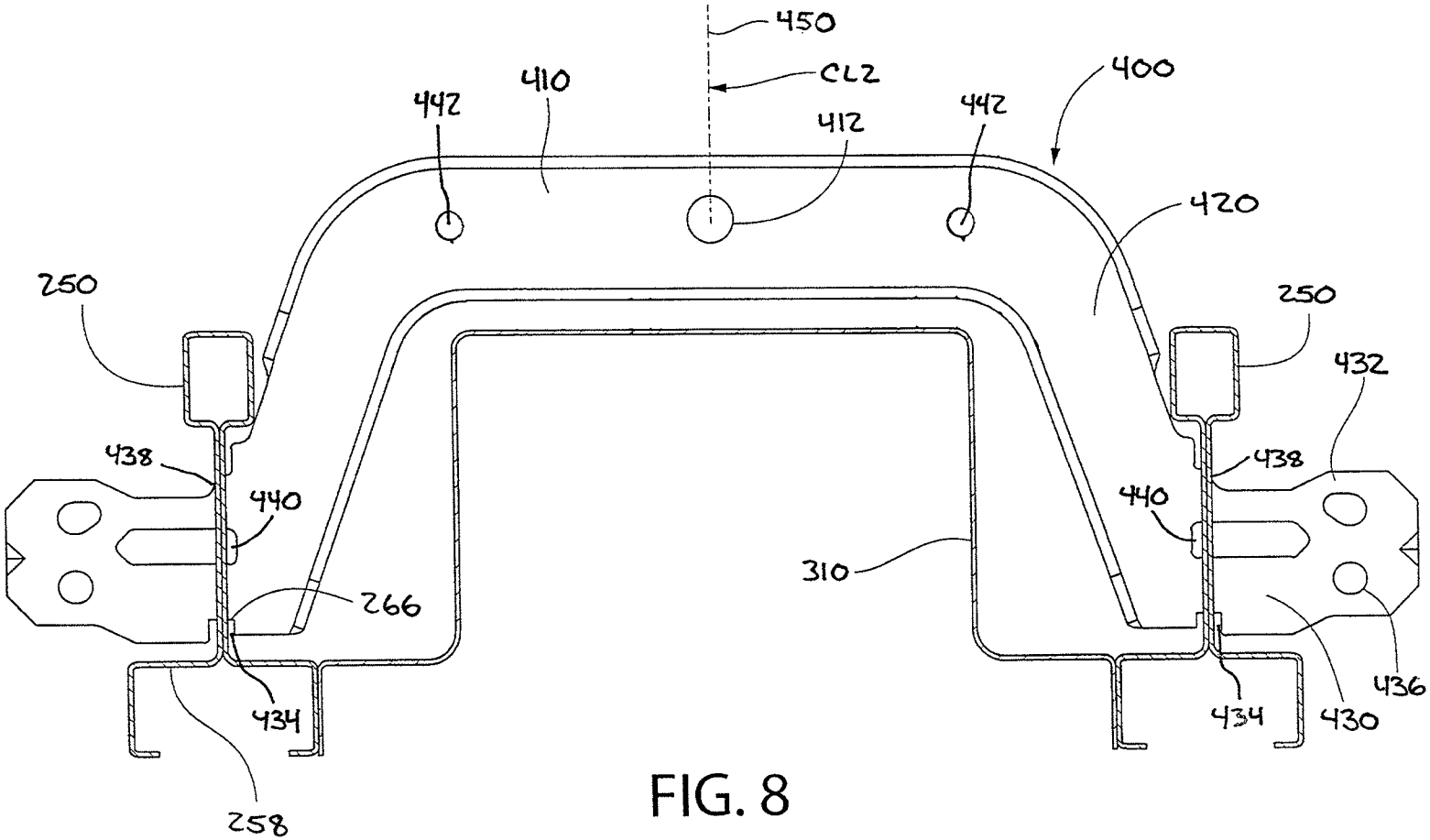
FIG. 8 is a transverse cross-sectional view of the lighting spacer bracket mounted between the lighting support members and a lighting module positioned therein, according to an embodiment of the present invention.
Figure 13:
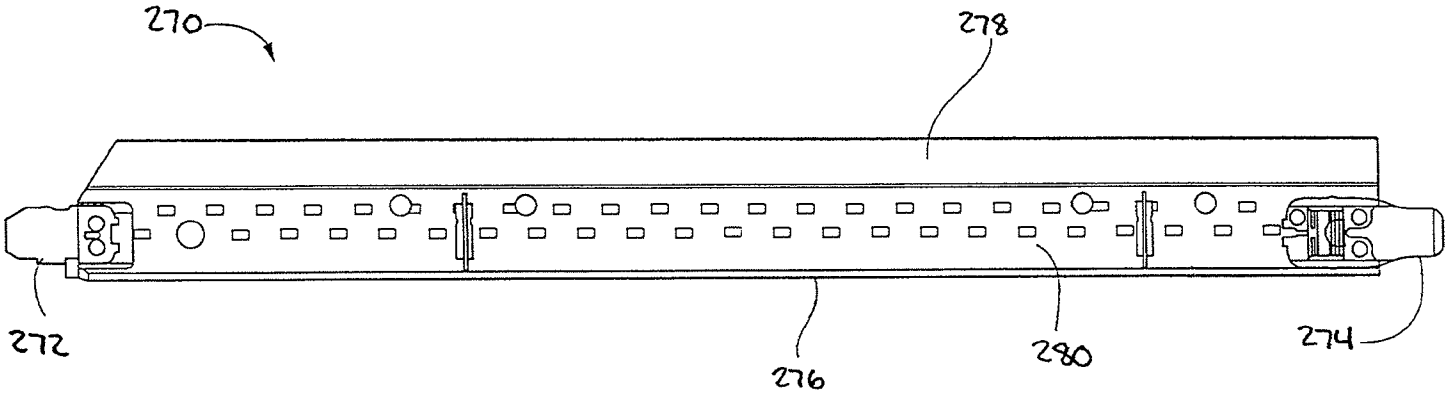
FIG. 13 is a side elevation of a grid adapter for optionally connecting the lighting support members to the grid system.

The terminal ends 252 of the lighting support members 250 may be configured similarly to the terminal ends 244 of the lateral grid support members 230 for engaging the vertical web 236 of a lateral grid support member 230 as shown in FIGS. 1, 2 and 7 regardless of whether longitudinal grid support members 210 or differently configured lighting support members are used as the lighting support members 250. In some overhead grid support systems with standardized components, the terminal ends 224 of the longitudinal grid support members 210 may have pre-fabricated ends only configured to engage the end connections of other longitudinal grid support members. Therefore, types of longitudinal grid support members 210 would not be compatible for coupling to the webs 236 of lateral grid support members 230 for forming the lighting opening 300. Accordingly, in certain embodiments, a special grid adapter 270 shown in FIGS. 1 and 13 may be provided to compensate for standardized end connections. Grid adapter 270 has a first type terminal end 272 configured for end-to-end coupling to an adjoining terminal end 224 of a longitudinal grid support member 210, and a second type terminal end connection 275 configured for end-to-side coupling (e.g. perpendicular) with the vertical web 236 of a lateral grid support member 230. The grid adapters 270 offered for standardized grid support systems may have a fixed length, such as without limitation 12 inches in some embodiments. For such installations to form a lighting opening 300 in the overhead grid support system 200, the lighting support members 250 would be selected to be 12 inches shorter, for example, at each end than the distance L1 between the lateral grid support members 230 between which the lighting opening is to be formed (see also FIG. 1). The 12 inch shortage on each end of the lighting support members 250 would be filled by providing two grid adapters 270 for each terminal end of the lighting support members 250. Other lengths of grid adapters and lighting support members may of course be used. Like the longitudinal grid support members 210 and the lateral grid support members 230, each of the grid adapters 270 may include a longitudinally-extending horizontal bottom flange 276, an enlarged top stiffening channel 278 (also referred to as a bulb), and a vertical web 280 extending between the bottom flange 276 and the stiffening channel 278. In some embodiments, the stiffening channel 278 may be excluded To support the lighting support members 250 due to the lack of lateral grid support members 230 extending through the lighting opening 300 and additional weight of the lighting modules 310, a lighting spacer bracket 400 may be provided. Referring to FIGS. 8-11, the lighting spacer bracket 400 is configured to span the width W1 of the lighting opening 300 and laterally engage each of the lighting support members 250. The lighting spacer bracket 400 in turn may be hung from the overhead support structure via hanger elements 450 which are coupled to each lighting spacer bracket 400. Any suitable number of lighting spacer brackets 400 may be provided for each lighting opening 300, depending on the length of the lighting opening and lighting module 310 supported therein by the lighting support members 250. The spacer brackets 400 are preferably configured to not interference with the mounting the lighting modules 310 in the lighting openings 300.

Figure 4:
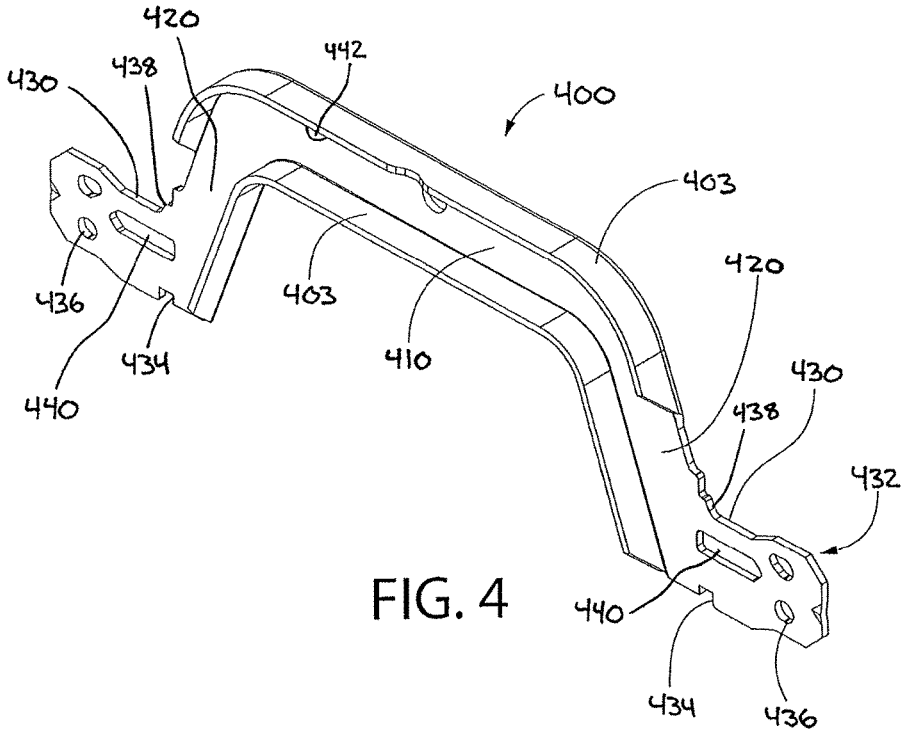
FIGS. 4-6 are plan and perspective views of a lighting spacer bracket mountable in the lighting support members, according to an embodiment of the present invention.
Figure 5:
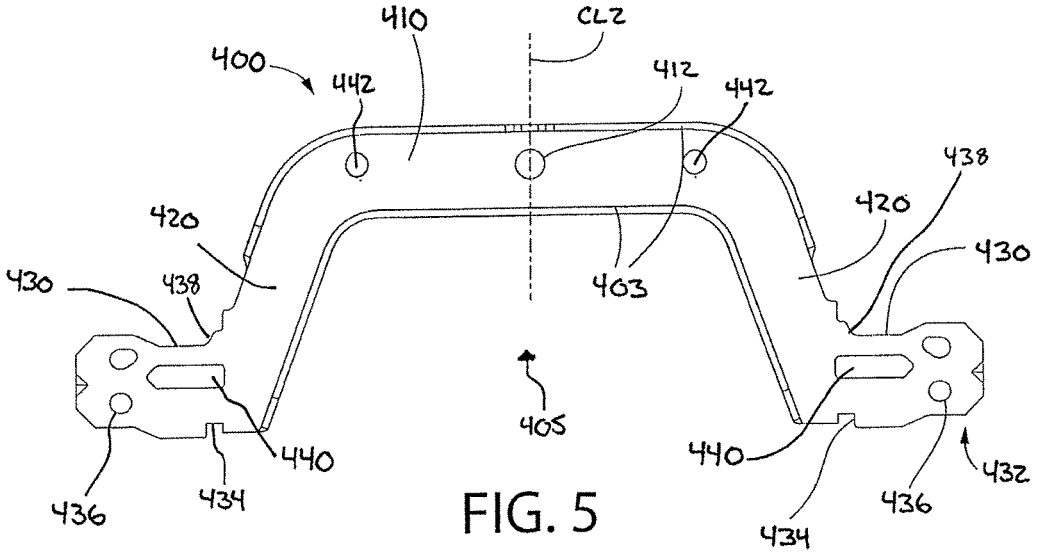
Figure 6:
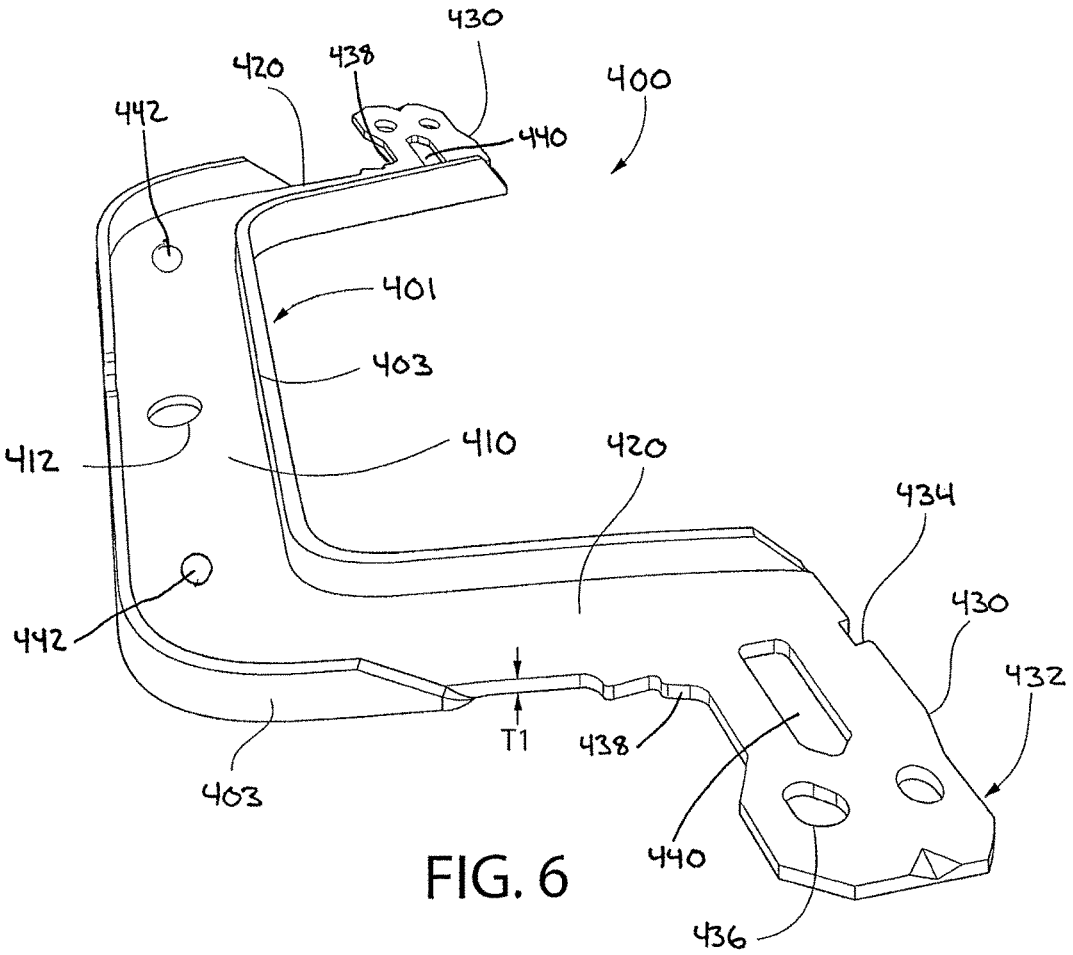

FIGS. 4-6 show the lighting spacer bracket 400 in greater detail. In one embodiment, the lighting spacer bracket 400 includes a generally U-shaped body 401 including a horizontal top wall 410 and opposing laterally spaced apart vertical sidewalls 420. The top wall 410 and sidewalls 420 define a downwardly open cavity 405 configured for receiving the lighting module 310 therein. In one embodiment, the opposing edges of top wall 410 and an adjoining portion of each of the sidewalls 420 may include stiffening flanges 403 to structurally stiffen the lighting spacer bracket 400 for resisting deformation by twisting and torsion. This allows the lighting spacer bracket 400 to be formed with a minimum thickness T1.

The body 401 of the lighting spacer bracket 400 may be made of a suitable material including metal and non-metal. In one embodiment, the bracket is made of flat metal plate or sheet of material formed to shape, such as without limitation aluminum, titanium, steel, or other. In one implementation, the lighting spacer bracket 400 is made of cold rolled steel which may be coated for corrosion resistance. The thickness T1 is substantially smaller than the lateral width and/or height of the lighting spacer bracket 400. A metal lighting spacer bracket 400 including the stiffening flanges 403 may be formed and machined by any suitable metal fabrication method such as bending, stamping, rolling, forging, casting, cutting, milling, welding, soldering, combinations thereof, and other. A mon-metal lighting spacer bracket 400 may be formed by suitable methods, including without limitation, molding and others.

With continuing reference to FIGS. 4-6, the lighting spacer bracket 400 may further include mounting extensions 430 protruding laterally outwards from each of the sidewalls 420 in opposite directions. Each mounting extension 430 is configured to engage one of the pair of lighting support members 250. The mounting extensions 430 have an end portion 432 configured for insertion through mounting slots 266 formed in the lighting support members 250. The bottom of each mounting extension 430 may include a notch 434 configured for engaging the vertical web 256 of the lighting support member 250 inside the mounting slot 266. This prevents the lighting spacer bracket 400 from sliding laterally through the slot to maintain the lateral spacing between the lighting support members 250 during the grid erection process. The top of each mounting extension 430 may also a ramp 438 above the notch 434. When the lighting spacer bracket 400 is inserted through the mounting slot 266, the ramp 438 contacts the top of the mounting slot 266 and forces the lighting spacer bracket 400 downward so that the notch 434 engages with the mounting slot 266.

The end portions 432 are further configured to couple to the terminal end 244 of a lateral grid support member 230 (FIGS. 1, 7, 9, and 10). In one embodiment, the end portions 432 may include one or more mounting holes 436 which may receive a fastener 460 such as a pop rivet, bolt, or similar element arranged to engage holes in the terminal end 244 of an adjoining lateral grid support member 230. This structurally ties the mounting extension 430 and spacer bracket 400 into lateral grid support members 230 forming a continuous support element essentially extending through the lighting opening 300. The end portions 432 may also include clearance slots 440 which prevents a connector which may be attached to the terminal end 244 of a lateral grid support member 230 from interfering with the lighting spacer bracket 400.

Referring to FIGS. 4-6 and 8-11, a hanger hole 412 in the top wall 410 may provide for conveniently securing the hanger element 450 to the lighting spacer bracket 400. In one embodiment, the hanger hole 412 may be centered along the centerline CL2 of the bracket. It will appreciated that more than one hanger hole 12, other shapes of the hole(s), and other methods and configurations may be used for securing the hanger element 450 to the lighting spacer bracket 400 depending on the type of hanger used. In some embodiments, the top wall 410 may include one or more additional holes 442 which may be used to secure the lighting module 300 to the lighting spacer bracket 400 by a securing cord or cable, etc. (not shown).

Figure 10:
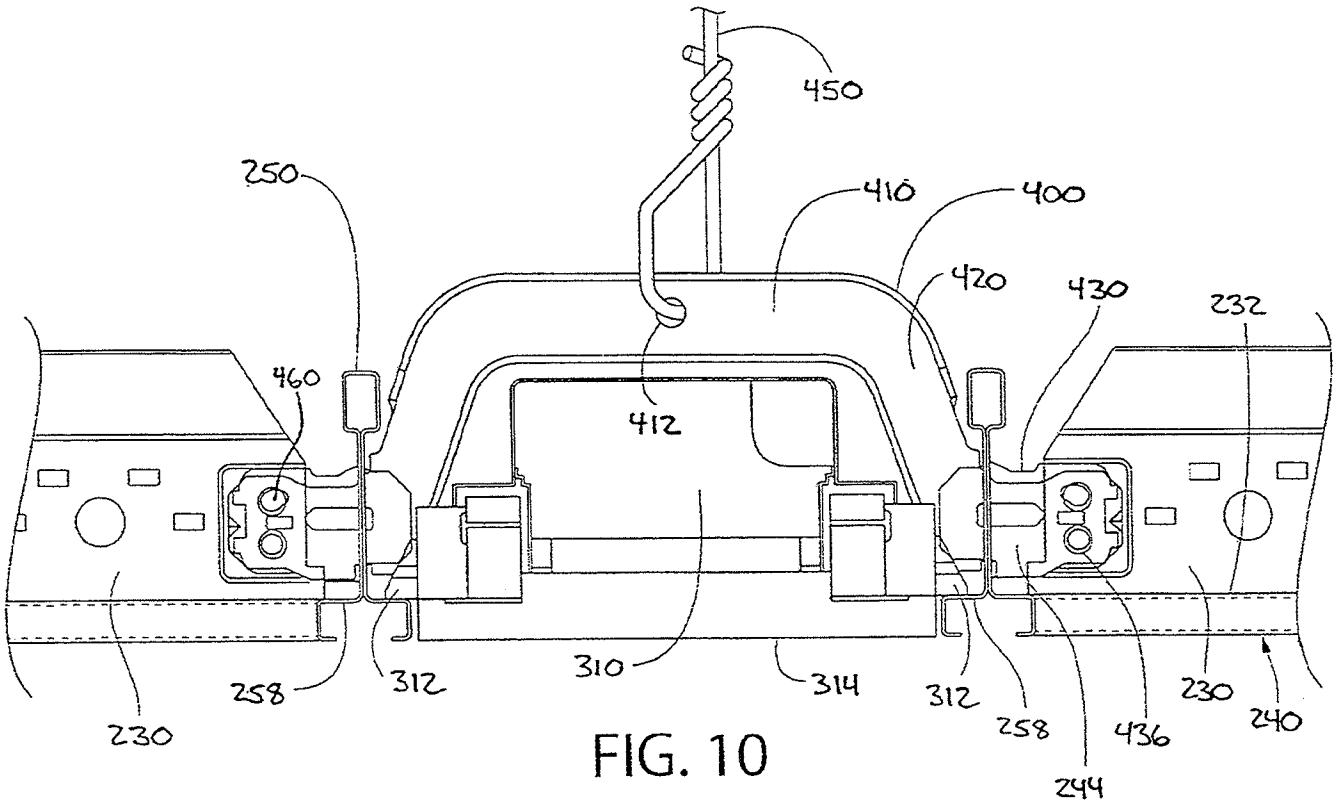
FIG. 10 an end view thereof showing the fully installed assembly including the lighting module, according to an embodiment of the present invention.
Figure 11:
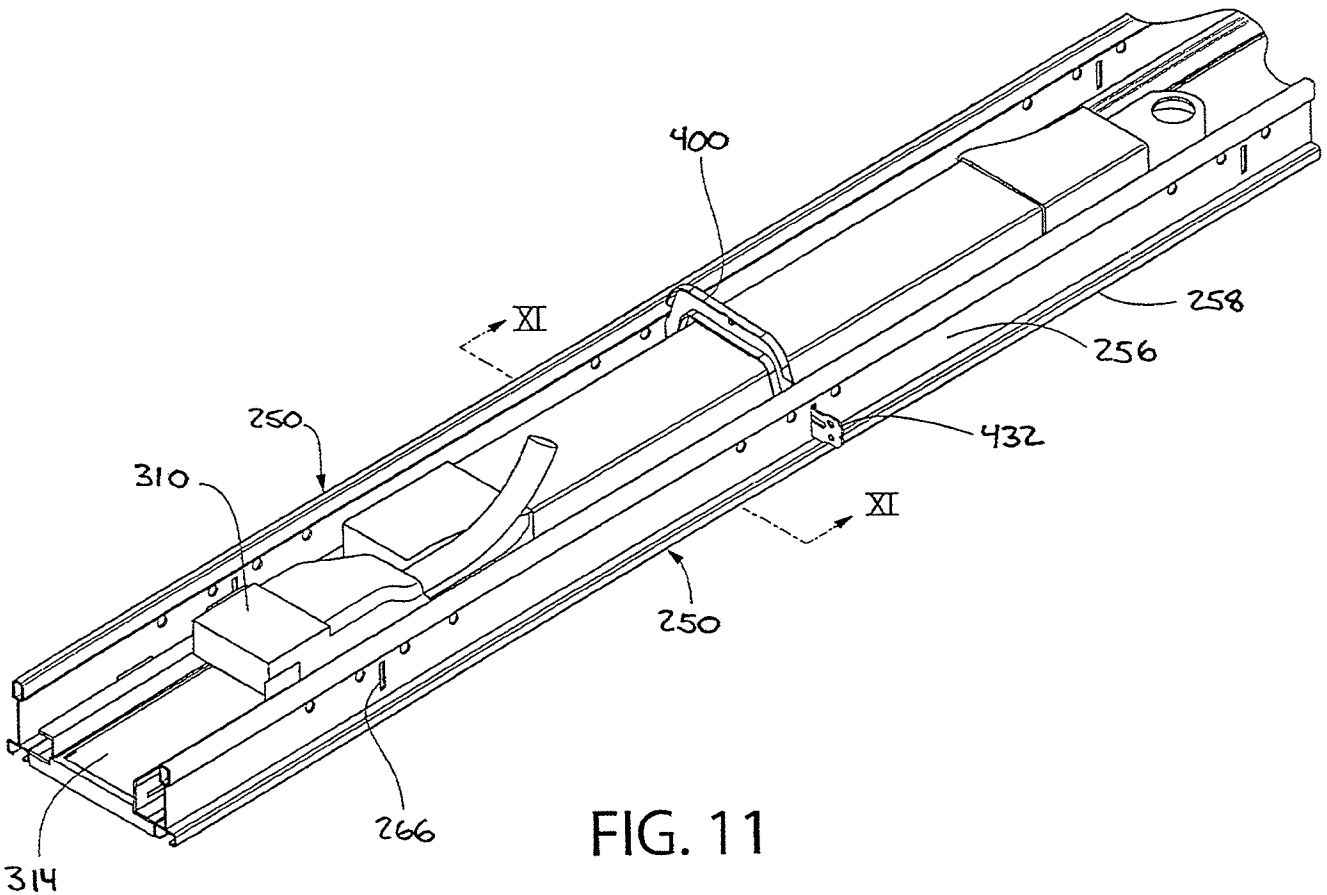
FIG. 11 is a top perspective view of the installed assembly of FIG. 10.

Once the lighting spacer bracket 400 has been mounted to the lighting support members 250, the lighting module 310 may be mounted in the lighting opening 300. The lighting module 310 includes one or more mounting features which allow the lighting module 310 to attach directly to each of the two lighting support members 250 forming lighting opening 300 from beneath the grid support system 200. In one non-limiting implementation, for example, the mounting feature may comprise a spring-loaded depressible latch 312 configured to engage the bottom flange 258 of the lighting support members 250 as best shown in FIG. 10. The latch 312 may be similar to a depressible door latch having a generally triangular configuration including a flat bottom surface to engage the top surface 260 of the bottom flange 258 and an adjoining inclined or convexly curved surface which faces outward away from the lighting module 310. The latch 312 is received in a cavity on the side of the lighting module 310 and is biased laterally outwards by a spring (not shown). When the curved surface initially engages the bottom surface 262 of the lighting support member 250 (on bottom flange 258) as the lighting module 310 is inserted vertically into the lighting opening 300, the latch 312 will be depressed inwards allowing the lighting module 310 to slip into the opening. The longitudinally extending edges 264 of the lighting support member 250 will act to retain the latch 312 in a depressed position while the lighting module 310 is inserted into the opening. Once the flat bottom surface of the latch 312 clears the bottom flange 258 of the lighting support member 250, the spring will force the latch 312 back outwards to engage top surface 260, thereby securing the lighting module 310 in the lighting opening 300. The lighting module 310 cannot be removed without manually depressing the latch 312 which may be accessible inside the frame of the lighting module 310. In some embodiments, the lighting module 310 may include a light-transmitting lens 314 which covers and closes the open bottom of the module.

Any type of lighting modules 310 may be used. In one embodiment, the lighting module 310 may be a zero plenum LED (light emitting diode) linear lighting module such as without limitation a Leno Zero Plenum LED luminaire model N243 available from XAL Inc. These types of fixtures have a height which either does not or only minimally protrudes above the grid members to avoid interference with mechanical or electrical utilities routed through the plenum formed above the grid support system 200. Other types of lighting modules may be used. It will be appreciated that a single or multiple modules may be positioned and supported in each lighting opening 300.

An exemplary method for mounting a lighting module in a ceiling system will now be described with initial reference to FIGS. 1-3.

A plurality of longitudinal grid support members 210 that form part of the grid support system 200 are provided and hung from an overhead ceiling support structure using the hanger elements 204. The longitudinal grid support members 210 are arranged in parallel relationship to each other as shown. The longitudinal grid support members 210 are horizontally spaced apart, each defining a longitudinal axis LA. The bottom flange 212 of each longitudinal grid support members 210 substantially lies in a common horizontal reference plane.

Next, two lateral grid support members 230 are installed between, and joined to, a pair of longitudinal grid support members 202 to define a grid opening 206 for the lighting module 310. The two lateral grid support members 230 form the framing headers at each end of the lighting opening 300 in which the lighting module 310 will be installed (see, e.g. FIG. 2). The two lateral grid support members 230 are preferably spaced apart by a distance L1 from each other which is substantially coextensive with the length of the lighting module 310. A hanger element 204 may be used and connected to the lateral grid support members 230 for additional support, but is not required.

A spaced pair of lighting support members 250 are next positioned and installed within the grid opening 206 in the grid support system 200 where the lighting module 310 is to be located (see, e.g. FIGS. 2 and 7). The terminal ends 252 of each lighting support member 250 are connected laterally through appropriately spaced mounting slots 246 formed in the vertical webs 236 of each of the two lateral grid support members 230. The lighting support members 250 engage each lateral grid support member 230 at approximately the middle of each lateral grid support member 230 in some arrangements. Other types of connections may be provided for securing the lighting support members 250 to the lateral grid support members 230.

Next, lighting spacer brackets 400 are installed between and engage the two lighting support members 250 at right angles. The lighting spacer brackets 400 are installed by inserting the lateral mounting extensions 430 through mounting slots 266 formed in the web 256 of the lighting support members 250. The mounting extensions 430 have a sufficient length to enable the end portions 432 to protrude through the mounting slots 266 sufficiently to enable connection to lighting support members 250 and adjoining lateral grid support members 230 intersecting the lighting support members 250. As the mounting extensions 430 are inserted through the mounting slots 266, the ramp 438 will engage with the top of the mounting slot 266 to force the mounting extension downward to engage the notch 434 and the bottom of the mounting slot 266. The notches 434 in each spacer bracket 400 may be engaged with the mounting slots 266 to hold the brackets in position. The spacer brackets may be further secured to the overhead ceiling support structure by hanger elements 450. A suitable number of lighting spacer brackets 400 may be installed and spaced along the length L1 of the lighting support members 250 as needed to properly support the weight of the lighting support members 250 and the lighting module 310 to be installed between the lighting support members 250.

Figure 9:
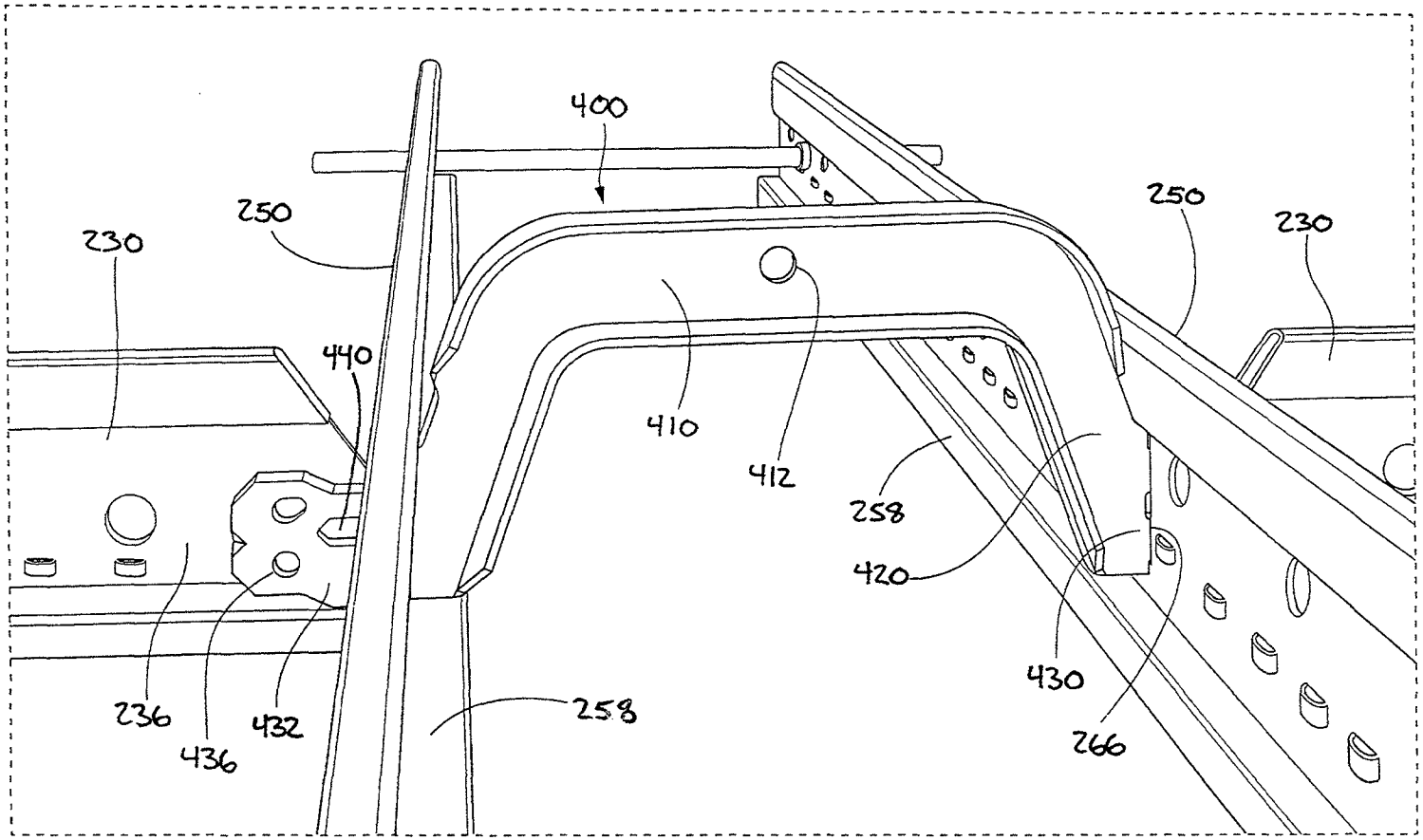
FIG. 9 is a perspective view showing the lighting spacer bracket, lighting support members, and adjoining lateral grid support members, according to an embodiment of the present invention.

Each lighting spacer bracket 400 is then preferably connected through the web 256 of lighting support members 250 to a lateral grid support member 230 intersecting the lighting spacer bracket 400 at one terminal end 244 of the intersecting lateral grid support member 230 (see, e.g. FIGS. 1, 9, and 10). The remaining terminal end 244 of the intersecting lateral grid support member 230 may be connected to an adjacent longitudinal grid support member 210. The mounting extensions 430 already extending through mounting slots 266 in the lighting support members 250 may be connected to the adjoining lateral grid support members 230 using mounting holes 4136, as previously described. Structurally, this arrangement advantageously ties the spacer brackets 400 into the overhead grid support system 200 by forming continuous horizontal support through the lighting opening 300 defined by the lighting support members 250 using the two adjoining intersecting lateral grid support members 230. It will be appreciated that in certain embodiments and arrangements contemplated, some of the lighting spacer brackets 400 may be secured only to the lighting support members 250 for supplemental support locations where an intersecting lateral grid support member 230 is not present.

Structurally, it should be noted that pair lighting support members 250 substitute for at least a portion of the total length L2 of the main beam longitudinal grid support members 210. This allows the lighting modules 310 to be oriented along and aligned with the longitudinal axis LA of a longitudinal grid support member 210 as shown in FIG. 1. Use of the lighting spacer brackets 400 secured into the lateral grid support members 230 which intersect the lighting support members 250 advantageously provide a seismically rated overhead grid support system 200.

The lighting installation process continues by horizontally positioning and centering a lighting module 310 beneath the lighting opening 300 defined by the lighting support members 250. The module is then raised and inserted into the opening 300 and secured to the lighting support members 259 via the retractable latches 312 as previously described. Additional lighting modules 310 may be installed in a similar manner if the linear lighting installation is to be formed with multiple modules at this lighting location.

The foregoing process may be repeated to add additional lighting openings 300 and lighting modules 310 to the overhead grid support system 200. It will be appreciated that the foregoing order of steps to install lighting modules 310 may be performed in other orders and/or may include additional or different steps. Accordingly, the installation method is not limited in this regard.

A plurality of additional first lateral grid support members 230 are provided in parallel relationship to each other in the arrangement as shown in FIG. 1 to complete the overhead grid support system 200. These lateral grid support members 230 are horizontally spaced apart transversely to the longitudinal axis LA between the longitudinal grid support members 210 and are attached thereto at their terminal ends 244. The lateral grid support members 230 may be oriented orthogonally and perpendicular to the longitudinal grid support members 210 and longitudinal axis LA. The bottom flange 232 of each lateral grid support member 230 substantially lies in a common horizontal reference plane with the bottom flanges 232 of the lateral grid support member 230 and the bottom flanges 212 of the longitudinal grid support members 2102. The bottom surfaces 220 of the longitudinal grid support members 210 and the bottom surfaces 240 of the lateral grid support members 230 each define a grid face.

Depending on the size of the ceiling panels 208 and the layout to be created, in some embodiments a second plurality of lateral grid support members 230 may optionally be installed perpendicular to the first plurality of lateral grid support members 230 and arranged parallel to the longitudinal grid support members 210, as shown in the layout of FIG. 1. This allows formation of a square grid pattern (e.g. 2 foot×2 foot, etc.) for corresponding square ceiling panels 250.

The intersecting longitudinal and lateral grid support members 202, 204 define the array of grid openings 206 each configured to receive a ceiling panels 208. The grid openings 206 may be rectilinear and are each surrounded by a pair of opposing longitudinally-extending grid faces and a pair of opposing laterally-extending grid faces surface (best shown in FIGS. 2 and 7). In some embodiments, the grid openings 206 may be orthogonal and include rectangular or square opening shapes.

Figure 12:
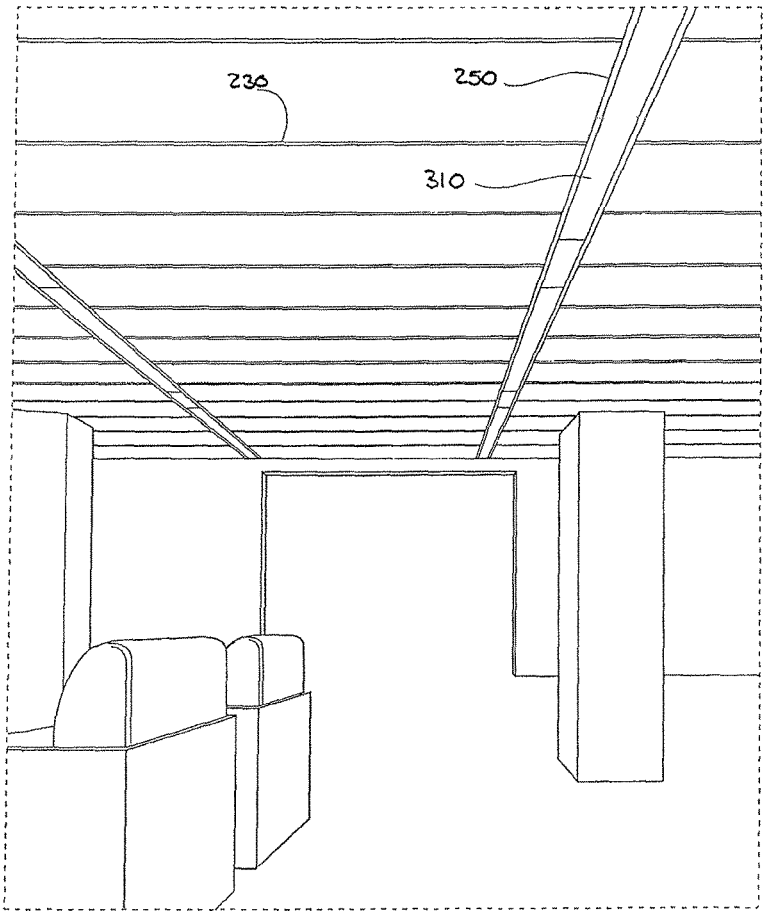
FIG. 12 is a bottom perspective view of a completed linear lighting ceiling system installation, according to an embodiment of the present invention.

Using the ceiling and lighting support system disclosed herein, various layouts of the lighting modules 310 are possible. For example, in one possible arrangement, the lighting module 310 run may be continuous in one axial direction from wall to wall of the building space (see, e.g. FIG. 12), thereby having a total length L1 the same as the wall-to-wall length L2 (length parameters shown in FIG. 1). In another possible arrangement, multiple lighting modules 310 may be intermittently spaced apart in an axial direction. Each lighting module segment in such a layout may have the same or different lengths L1. In yet another possible arrangement, a single lighting module run having a length L1 which is less than the wall-to-wall distance L2 in building space may be provided, as shown in FIG. 1. Numerous variations of the foregoing arrangements may be made.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

The foregoing description of preferred embodiments of the invention should be taken as illustrating, rather than as limiting, the present invention as defined by the claims. As will be readily appreciated, numerous variations and combinations of the features set forth above can be utilized without departing from the present invention as set forth in the claims. Such variations are not regarded as a departure from the spirit and scope of the invention, and all such variations are intended to be included within the scope of the following claims.

What is claimed is:

1. A lighting spacer bracket for supporting a lighting fixture in a ceiling system, the spacer bracket comprising:

an elongated body;

a substantially horizontal top wall;

a first sidewall extending downwardly from the top wall;

a second sidewall extending downwardly from the top wall, the first and second sidewalls spaced laterally apart;

a mounting extension having a terminal edge and protruding laterally outwards from each of the first and second sidewalls in opposite directions, each mounting extension, having a notch and a hole closer to the terminal edge of the mounting extension than to the opposite sidewall, the top wall and the side walls, configured to engage a lighting support member of a ceiling grid support system; and a downwardly open cavity defined collectively by the top wall, first sidewall, and second sidewall, the cavity configured to receive a lighting module.

2. The lighting spacer bracket according to claim 1, wherein the notch opens downwardly and is configured to engage a vertical edge of one of the lighting support members.

3. The lighting spacer bracket according to claim 1, wherein each mounting extension is configured for insertion through an elongated mounting slot formed through a respective lighting support member.

4. The lighting spacer bracket according to claim 1, wherein the body is formed of a planar plate or sheet of material.

5. The lighting spacer bracket according to claim 1, further comprising stiffening flanges formed on opposing edges of the top wall.

6. The lighting spacer bracket according to claim 1, wherein each mounting extension is further configured for connection to a terminal end of a respective lateral grid support member intersecting a respective one of a pair of the lighting support members.

7. The lighting spacer bracket according to claim 1, wherein the body has a U-shape.

* * * * *